US005686934A

United States Patent [19]

Nonoshita et al.

[11] Patent Number: 5,686,934

[45] Date of Patent: Nov. 11, 1997

[54] DISPLAY CONTROL APPARATUS

[75] Inventors: Hiroshi Nonoshita, Fujisawa; Kenzo Ina, Yokohama; Yoshitsugu Yamanashi, Tokyo; Eiichi Matsuzaki, Kawasaki, all of Japan

[73] Assignee: Canon Kabushiki Kaisha, Tokyo, Japan

[21] Appl. No.: 301,031

[22] Filed: Sep. 6, 1994

Related U.S. Application Data

[63] Continuation of Ser. No. 921,745, Jul. 30, 1992, abandoned.

[30] Foreign Application Priority Data

Aug. 2, 1991 [JP] Japan ..... 3-194179
Aug. 2, 1991 [JP] Japan ..... 3-194180
Aug. 2, 1991 [JP] Japan ..... 3-194259

[51] Int. Cl.[6] ..... G09G 3/36

[52] U.S. Cl. ..... 345/97; 345/99

[58] Field of Search ..... 345/95, 97, 94, 345/101, 87, 98, 208, 210, 99; 359/166

[56] References Cited

U.S. PATENT DOCUMENTS 4,101,879 7/1978 Kawaji et al. ..... 340/750
4,525,710 6/1985 Hoshi et al. .
5,059,961 10/1991 Cheng ..... 340/720
5,146,558 9/1992 Inoue ..... 395/166
5,175,567 12/1992 Asai ..... 346/140 R
5,606,343 2/1997 Tsuboyama et al. ..... 345/97

FOREIGN PATENT DOCUMENTS 0288168 10/1988 European Pat. Off. .
0355243 2/1990 European Pat. Off. .
0368117 5/1990 European Pat. Off. .
0424958 5/1991 European Pat. Off. .
0526097 2/1993 European Pat. Off. .
0217893 8/1990 Japan .

*Primary Examiner*—Regina D. Liang
*Attorney, Agent, or Firm*—Fitzpatrick, Cella, Harper & Scinto

[57] ABSTRACT

A preserving performance of a display state of a display having a ferroelectric liquid crystal (FLC) as a display device is effectively used, thereby realizing a long life of the display. For this purpose, access monitor device is provided. The access of a video memory by display data supply device is monitored. When there is no access for a predetermined time or more, that is, when there is no change in the present display content, display drive control device controls display driving device so as to stop the driving of an FLC panel.

14 Claims, 10 Drawing Sheets

DISPLAY CONTROL APPARATUS

This application is a continuation of application Ser. No. 07/921,745 filed Jul. 30, 1992, now abandoned.

BACKGROUND OF THE INVENTION

1. Field of the Invention

The invention relates to a display control apparatus and, more particularly, to a display control apparatus for a display apparatus having a display device in which, for instance, a ferroelectric liquid crystal is used as an operational medium to display and update and a display state updated by the supply of an electric field or the like can be held.

2. Related Background Art

Generally, a display apparatus used as an information display means to perform a visual display function of information is connected to an information processing system or the like. A CRT is widely used as such a display apparatus. However, a volume of the whole CRT is large because, in particular, a certain thickness of the display screen is needed, so that it is difficult to miniaturize the whole display apparatus. Consequently, degrees of freedom when using the information processing system using such a CRT as a display, that is, degrees of freedom regarding the installing location, portability, and the like are lost.

As a device to compensate such a problem, a liquid crystal device (hereinafter, referred to as an LCD) can be used. That is, according to the LCD, the whole display apparatus can be miniaturized (in particular, the display apparatus is made thin). Among those LCDs, there is a display (hereinafter, referred to as an FLCD: Ferroelectric Liquid Crystal Display) using liquid cells of a ferroelectric liquid crystal (FLC). One of the features of the FLCD is that the liquid crystal cell has a preserving performance of the display state for the supply of an electric field. Therefore, in case of driving the FLCD, different from the CRT or other liquid crystal displays, there is enough time in the continuous refresh driving period of the display screen. In addition to the continuous refresh driving, a partial rewriting driving to update the display state of only the portion corresponding to the change on the display screen can be performed. Therefore, such an FLCD can construct the display of a larger screen as compared with the other liquid crystal displays.

A liquid crystal cell of the FLCD is sufficiently thin and molecules of the elongated FLC in the liquid crystal cell are oriented in a first or second stable state in accordance with the applying direction of the electric field. Even when the supply of the electric field is stopped, their orienting states are maintained. The FLCD has a storing performance due to such a bistability of the molecules of the FLC. Such FLC and FLCD have been disclosed in detail in, for example, Japanese Patent Appln. Laid-Open No. 632243919.

However, the above conventional FLCD does not sufficiently utilize the storing performance of the FLCD.

SUMMARY OF THE INVENTION

It is an object of the invention to provide a display control apparatus which can realize a long life of a display panel of an FLCD or the like by effectively using the preserving performance of a display state in the FLCD or the like.

Another object of the invention is that a proper driving stop state of a display can be obtained in accordance with a using state of the apparatus.

DETAILED DESCRIPTION OF THE PREFERRED EMBODIMENTS

(1) First Embodiment (1.1) Outline

Figure 1:
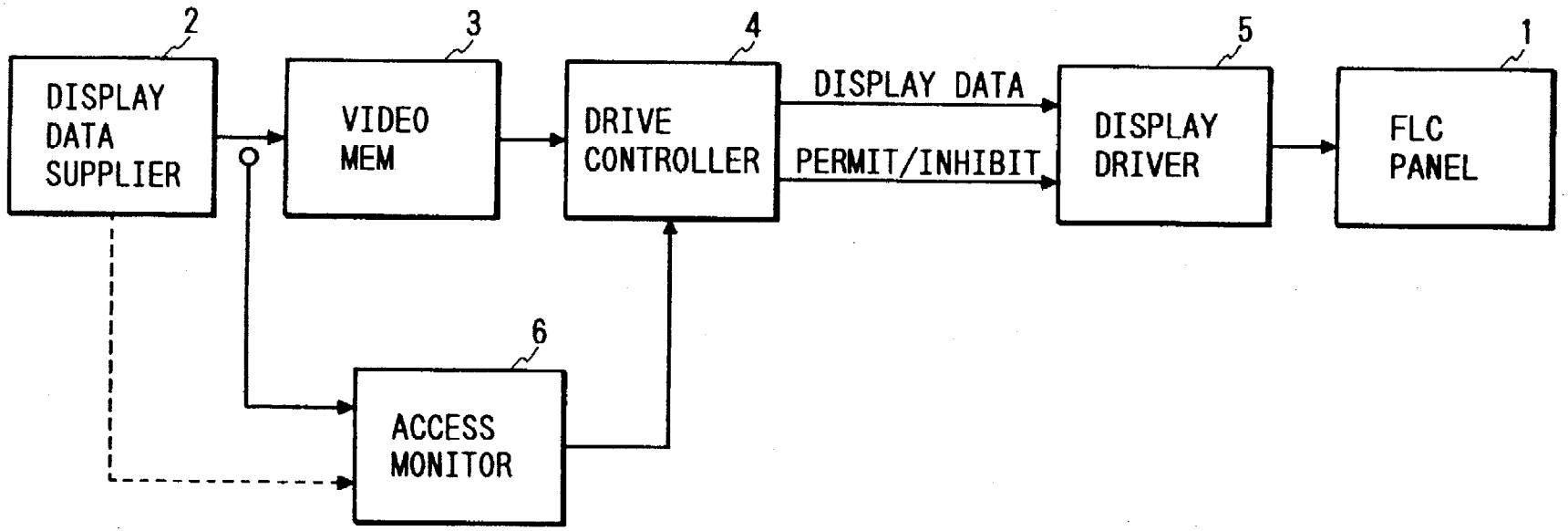
FIG. 1 is a block diagram for explaining an outline of an embodiment.
Figure 2:
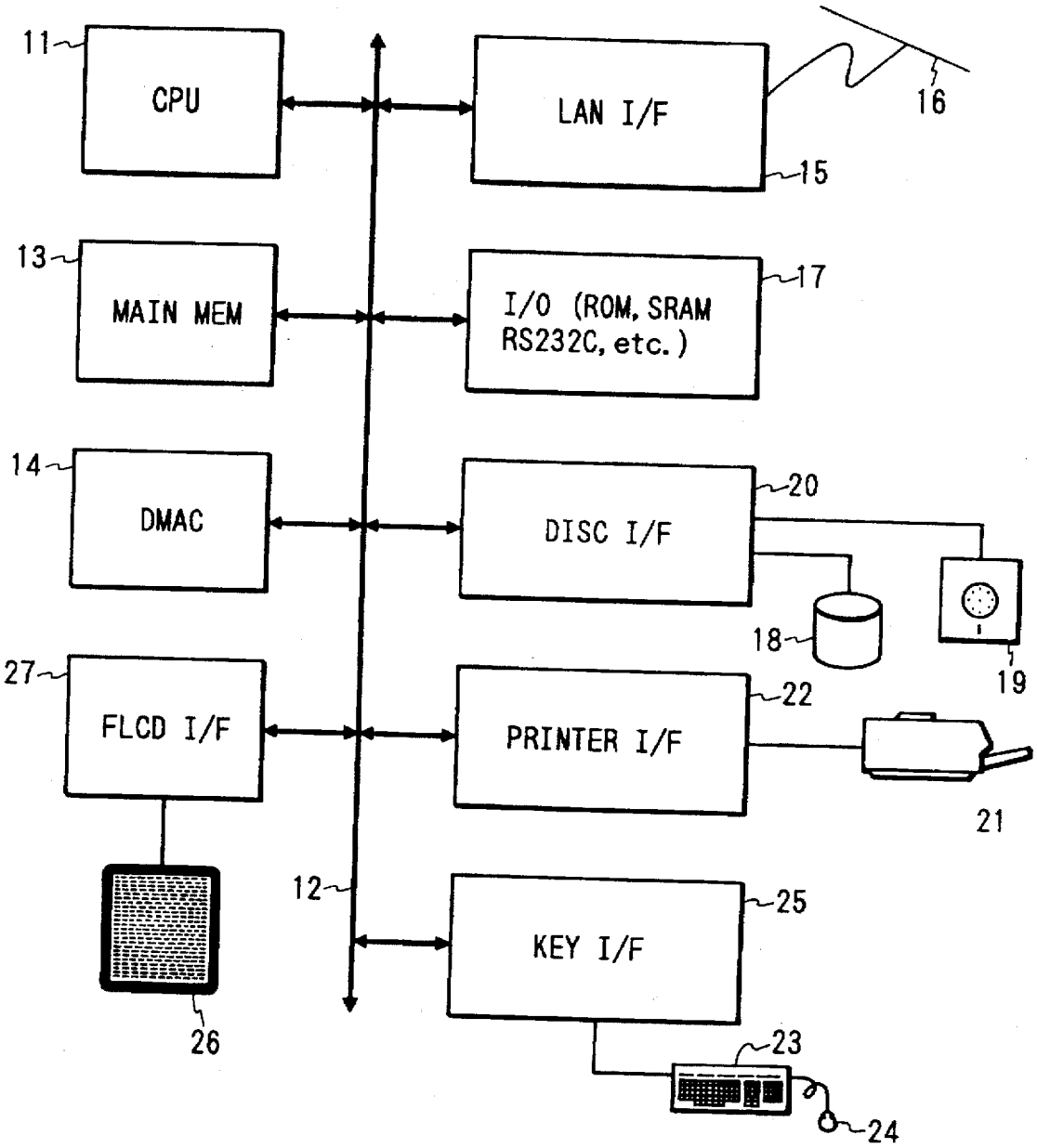
FIG. 2 is a block diagram of a whole information processing system having therein a display control apparatus of the embodiment of the invention.

FIG. 1 is an explanatory diagram showing an outline of the first embodiment of the invention. In FIG. 1, reference numeral 2 denotes a display data supplier (for instance, an information processing system as shown in FIG. 2 can be used; however, the display data supplier is not limited to such a system) serving as a host apparatus for a display (FLC panel) 1 which is constructed by using an FLC device. The display data supplier 2 accesses a video memory 3 when data is displayed, erased, updated, or the like. A drive controller 4 allows the content in the video memory 3 to be displayed (partially rewritten or refreshed) on the FLC panel 1 through a display driver 5. It is one of the features of the embodiment that an access monitor 6 is provided to monitor the access to the video memory 3 by the display data supplier 2 and, when there is no access for a predetermined time or more, namely, when there is no change in the present display contents, the drive controller 4 instructs the display driver 5 to inhibit the driving of the FLC panel 1. As mentioned above, since the FLC device holds one of the two orientating states even if the driving is stopped, an inconvenience such that the display data is extinguished on the FLC panel 1 or the like does not occur. The visibility of the operator is not lost so long as a light source such as what is called a back light or the like is assured.

By forming a state to stop the driving of the FLC panel 1 (such a state is hereinafter referred to as a static mode) as mentioned above, the deterioration of the FLC device due to the continuous driving is delayed, a long life of the FLC panel can be accomplished, and an electric power consumption can be reduced. Since a flickering or the like by refreshing does not also occur in the static mode, a degree of fatigue of the eyes of the operator can be also reduced.

A period of time which is required until the operating mode is shifted to the static mode can be varied in accordance with the using state of the information processing system, for instance, a difference of the application or a degree of skill of the operator. That is, there is a case where the display content is frequently updated in dependence on the application which is used or as a degree of skill of the operator is high. Therefore, a period of time which is required until the operating mode is shifted to the static mode is set to a long time, thereby making it possible to promptly cope with the updating of the display content.

On the contrary, when the display content is not frequently changed or the degree of skill of the operator is low, the period of time which is required until the operating mode is shifted to the static mode is set to a short time, thereby enabling the static mode to be obtained relatively quickly. In case of a system in which there is no need to make the shift time variable, such a time can be set to a fixed time.

(1.2) Information Processing System

FIG. 2 is a block constructional diagram of a whole information processing system having a display control apparatus according to an embodiment of the invention.

In the diagram, reference numeral 11 denotes a CPU to control the whole information processing system; 12 a system bus comprising an address bus, a control bus, and a data bus; 13 a main memory which is used to store a program and is used as a work area of the CPU 11; 14 a direct memory access controller (hereinafter, referred to as a DMAC) to transfer data between the main memory 13 and various apparatuses without being subjected to the control of the CPU 11; 15 an LAN (local area network) interface to connect with an LAN 16; 17 an input/output (I/O) device for connection with I/O devices comprising an ROM, an SRAM, an interface of the RS232C standard, and the like; 18 a hard disc device; 19 a floppy disk device; 20 a disc interface for the hard disc device 18 or floppy disk device 19; 21 a printer such as a laser beam printer, ink jet printer, or the like; 22 a printer interface for the printer 21; 23 a keyboard to input characters, numerals, and the like and to perform other inputs; 24 a mouse as a pointing device; 25 an interface for the keyboard 23 or mouse 24; 26 an FLCD (FLC display) which can be constructed by using a display disclosed in, for example, Japanese Patent Appln. Laid-Open No. 63-243919 or the like by the same applicant as the present invention; and 27 an FLCD interface for the FLCD 26.

(1.3) FLCD Interface

Figure 3:
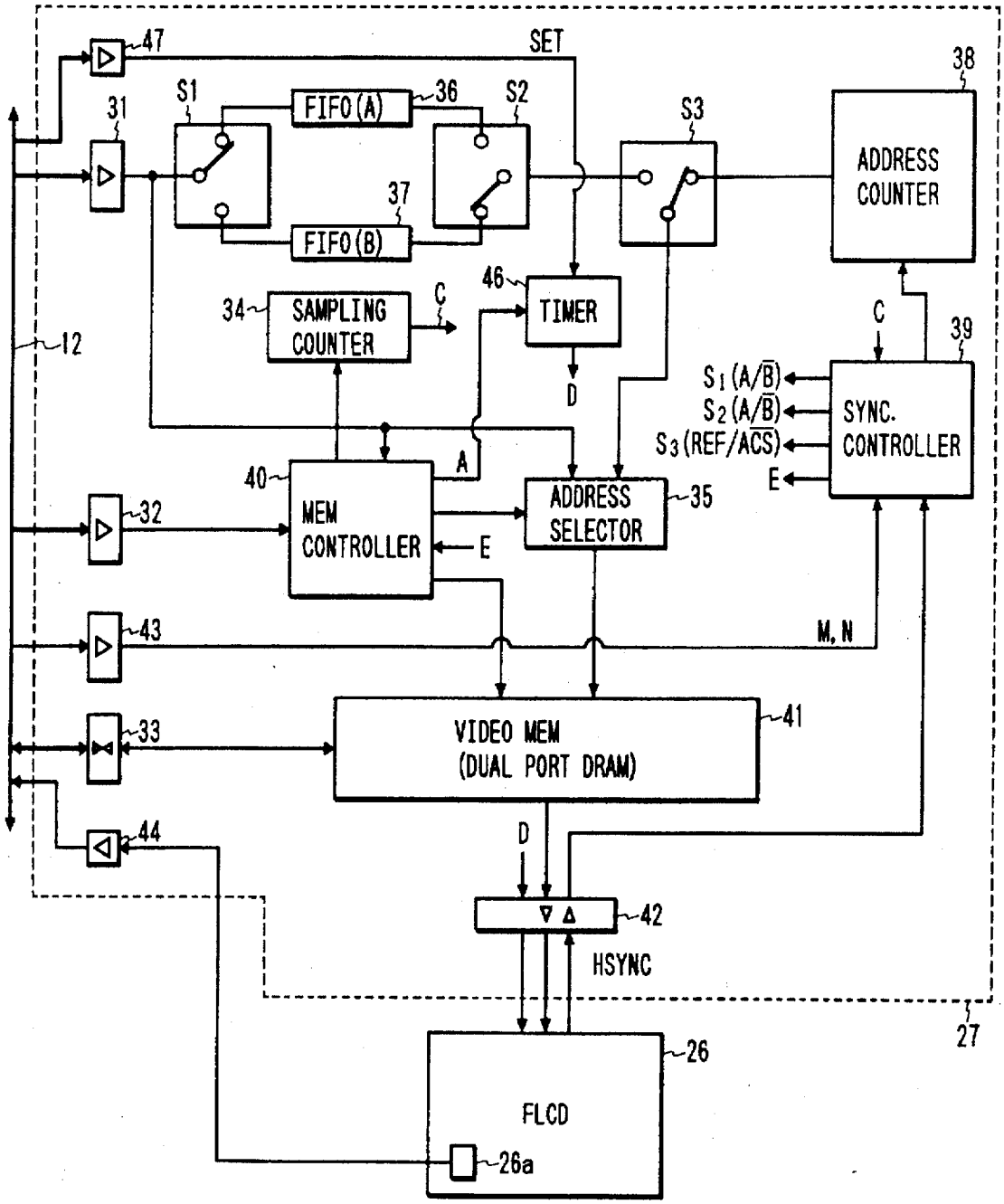
FIG. 3 is a block diagram showing a construction of an FLCD interface as an embodiment of the invention.

FIG. 3 is a block diagram showing an example of a construction of the FLCD interface 27 as an embodiment of the display control apparatus of the invention.

In the diagram, reference numeral 31 denotes an address bus driver; 32 a control bus driver; and 33, 43, and 44 data bus drivers. The address data from the CPU 11 is supplied from the address bus driver 31 to a memory controller 40 and one input terminal of an address selector 35 and is also selectively supplied to an FIFO memory 36 or 37 and stored therein by the switching of a first switch $S_1$. That is, the memories 36 and 37 are the FIFO (First-in First-out) memories from which the data is read out in accordance with the writing order (hereinafter, the memories 36 and 37 are referred to as FIFO(A) and FIFO(B)). The address data written in the memories 36 and 37 are selectively read out on the basis of the switching of a second switch $S_2$.

The address data read out from the FIFO(A) 36 or FIFO(B) 37 and the address data from an address counter 38, which will be explained hereinlater, are selected by the switching of a third switch $S_3$ and is given to the other input terminal of the address selector 35. The address counter 38 generates the address data to sequentially refresh the whole screen line by line. A timing to generate the address data is controlled by a sync controller 39. The sync controller 39 also generates switching control signals of the switches $S_1$, $S_2$, and $S_3$ and a data transfer request signal to the memory controller 40, which will be explained hereinlater.

A control signal from the CPU 11 is supplied from the control bus driver 32 to the memory controller 40. The memory controller 40 generates control signals of the sampling counter 34, the address selector 10, and a video memory 41, which will be explained hereinlater. The sampling counter 34 executes the counting operation on the basis of the control signal given from the memory controller 40 and generates a control signal to control the sync controller 39. On the basis of the control signal given from the memory controller 40, the address selector 35 selects either one of the two address data which are supplied to the input terminals of the address selector 35 and transmits to the video memory 41.

The video memory 41 stores the display data and is constructed by a dual-port DRAM (dynamic RAM) and executes the writing and reading operations of the display data through the data bus driver 33. The display data written in the video memory 41 is transferred to the FLCD 26 through a driver receiver 42 and is displayed. The driver receiver 42 supplies a sync signal from the FLCD 26 to the sync controller 39. The FLCD 26 has therein a temperature sensor **26*a*** to detect a temperature of FLC.

Set data, which will be explained hereinlater, which is given from the CPU 11 is sent to the sync controller 39 through the data bus driver 43. Further, an output signal of the temperature sensor **26*a* is transferred to the CPU 11 through the data bus driver 44. Reference numeral 46 denotes a timer whose measuring time can be changed by the CPU 11 through a bus driver 47. The timer 46 is reset by an access signal A which is generated from the memory controller 40 each time it is accessed by the CPU 11. After that, the timer 46 is restarted. After the address signal A was supplied, when the next access signal A is not supplied within a set time, the timer 46** generates a time-up signal D.

(1.4) Display Updating Operation

In the above construction, when the CPU 11 changes the display data, the CPU 11 gives an address signal of the video memory 41 corresponding to the rewriting of the display data to the memory controller 40 through the address bus driver 31. The memory controller 40 executes the arbitration of the memory access request signal which is given from the CPU 11 and the data transfer request signal which is given from the sync controller 39. When the CPU 11 obtains a right to access, the memory controller 40 instructs the address selector 35 to select the address signal which has been given from the CPU 11 as an address which is supplied to the video memory 41. At the same time, a control signal is given from the memory controller 40 to the video memory 41, thereby writing the display data through the data bus driver 33. In this instance, the CPU access address is stored into the FIFO(A) 36 or FIFO(B) 37 by the switching of the switch $S_1$ and is used when transferring the display data, which will be explained hereinlater. As mentioned above, the accessing method of the display data when it is seen from the CPU 11 is similar to that in case of the CRT.

When the data stored in the video memory 41 is transferred to the FLCD 26, a data transfer request signal is supplied from the sync controller 39 to the memory controller 40. As an address to the video memory 41, the address selector 35 selects the address which is given from the address counter 38 or the address stored in the FIFO(A) or FIFO(B) in accordance with an instruction from the memory controller 40. In the video memory 41, the data of the relevant address is transferred from the memory cell to a shift register on the basis of the control signal for data transfer which is given from the memory controller 40 and the address selected by the address selector 35. The data is generated to the driver receiver 42 by a control signal of a serial port.

On the basis of a horizontal sync signal HSYNC which is given from the FLCD 26, the sync controller 39 produces a timing to alternately execute a refreshing cycle for line-sequentially refreshing the whole screen on a unit basis of a plurality of lines and a rewriting cycle of the access line to rewrite the line accessed by the CPU 11. The whole surface refreshing cycle denotes that the lines are sequentially rewritten from the top line (head line) on the display screen toward the lower line and, when the target line reaches the lowest line, the target line is again returned to the head line and the rewriting operation is repeated. The rewriting cycle of the access line denotes that the line accessed from the CPU 11 within a predetermined time just before the rewriting cycle is rewritten.

According to the embodiment as mentioned above, the refreshing cycle to sequentially refresh the whole screen of the FLC display 26 and the rewriting cycle of the access line to rewrite the line accessed by the CPU 11 in order to change the display contents are time-sharingly alternately executed fundamentally. Further, a repeating period of both of those cycles and a time ratio between both of the cycles in one period can be made variable. The period of time of the rewriting (partial rewriting) cycle of the access line is adjusted in accordance with the number of lines accessed by the CPU 11.

The fundamental operation in the embodiment to time-sharingly alternately perform the refreshing cycle and the rewriting cycle of the access line will now be described with reference to FIG. 4. The case where the refreshing cycle is executed on a 4-line unit basis and the rewriting cycle of the access line is performed on a 3-line unit basis is shown here as an example.

Figure 4:
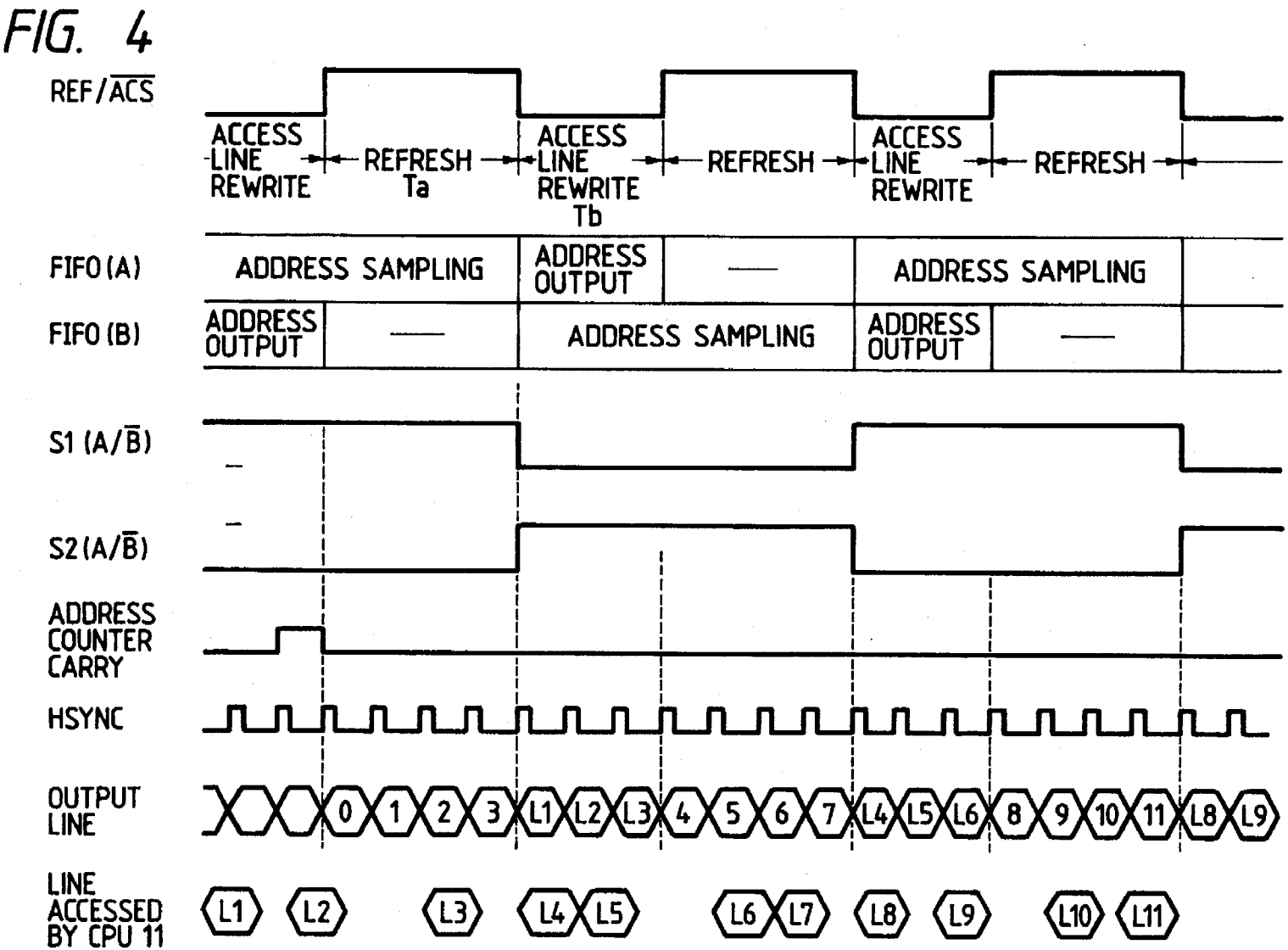
FIG. 4 is a timing chart for explaining the fundamental operation of the FLCD interface shown in FIG. 3.

In FIG. 4, REF/$\overline{\text{ACS}}$ indicates a timing to alternately execute the refreshing cycle and the rewriting cycle of the access line. When REF/$\overline{\text{ACS}}$ is set to "1", the refreshing cycle is executed, and when it is set to "0", the rewriting cycle of the access line is performed. $T_a$ denotes a time of the refreshing cycle and $T_b$ indicates a time of the access line rewriting cycle. In the embodiment, $T_a$:$T_b$=4:3. However, values of $T_a$ and $T_b$ are selected to optimum values in accordance with a required refresh rate or the like. That is, by setting $T_a$ to a large value, the refresh rate can be raised. By setting $T_b$ to a large value, a response speed of a partial change can be raised. This point will be explained hereinlater.

States of the FIFO(A) 36 and FIFO(B) 37 will now be explained. When the switch $S_1$ is connected to the FIFO(A) 36 side ($S_1(A/\overline{B})=1$), the address of the line which is accessed by the CPU 11 is sampled into the FIFO(A) 36 and stored. When the switch $S_1$ is connected to the FIFO(B) 37 side ($S_1(A/B)=0$), the address of the line which is accessed by the CPU 11 is stored into the FIFO(B) 37. When the switch $S_2$ is connected to the FIFO(A) 36 side ($S_2(A/\overline{B})=1$), the address stored in the FIFO(A) 36 is generated. When the switch $S_2$ is connected to the FIFO(B) 37 side ($S_2(A/\overline{B})=0$), the address stored in the FIFO(B) 37 is generated.

When one refreshing operation of the whole screen is completed and the FLCD 26 generates a vertical sync signal or a carry occurs in the address counter 38, the content in the address counter 38 is cleared and the line which is generated in the next refreshing cycle is started from the 0th line. Each time a horizontal sync signal HSYNC is supplied from the FLCD 26 through the sync controller 39, the address counter 38 sequentially counts up such as "1", "2", "3", . . . . When the addresses of the lines $L_1$, $L_2$, and $L_3$ are accessed by the CPU 11 during such a period of time of the counting up operation, since the switch $S_1$ has been connected to the FIFO(A) 36, the addresses of the lines $L_1$, $L_2$, and $L_3$ are stored into the FIFO(A) 36. After that, when the switch $S_2$ is connected to the FIFO(A) 36, the addresses of $L_1$, $L_2$, and $L_3$ are generated from the FIFO(A) 36 and $L_1$, $L_2$, and $L_3$ are selected as output lines. The signal REF/$\overline{\text{ACS}}$ which is generated from the sync controller 39 is given as a switching signal of the switch $S_3$. In the line access rewriting cycle, the switch $S_3$ is switched to the sides of the FIFO(A) and FIFO(B).

Since the switch $S_1$ has been connected to the FIFO(B) 37 side in this instance, the access line address is stored into the FIFO(B) 37. When REF/$\overline{\text{ACS}}$ is set to "1", the switch $S_3$ is connected to the address counter 38 side and the refreshing operation is executed from the line subsequent to the previous cycle. In FIG. 4, after completion of the output of the line $L_3$, the lines of "4", "5", "6", and "7" subsequent to the previous cycle are generated. In a manner similar to the above, the above operations are repeated. The reason why two FIFOs are prepared is to efficiently simultaneously execute both of the sampling of the memory accessed address in one of the two FIFOs and the generation of the sampled address from the other FIFO. That is, the address sampling period denotes a period of time from the start of the generation of the access line of the other FIFO to the end of the refreshing cycle of the whole surface. After completion of the refreshing cycle of the whole surface, the rewriting cycle of the access line to generate the address sampled in the sampling period just before the refreshing cycle is started. At the same time, the address sampling period of the other FIFO is started.

The embodiment has been described above with respect to the case where the refreshing cycle and the rewriting cycle of the access line are alternately repeated in the fundamental operation and, in FIG. 4, the repeating period is set to seven lines as one unit and $T_a$:$T_b$=4:3. In the embodiment, further, the ratio between $T_a$ and $T_b$ can be varied due to a refresh rate or the like which is required in accordance with environmental conditions such as a temperature and the like, the kind of data to be displayed, a difference of a display device material of the FLCD, or the like. That is, when a ratio (corresponding to the number M of lines in one refreshing cycle: that is, $T_a$=M×(period of HSYNC)) of $T_a$ is set to a large value, the refresh rate can be improved. For example, even when the response speed of the FLC device is low in the case where the temperature is low or the like or even when an image is displayed, a good display state can be obtained. On the contrary, when a ratio (corresponding to the number N of lines in one partial rewriting cycle: namely, $T_b$=N×(period of HSYNC)) of $T_b$ is set to a large value, a response speed of a change of the partial display content can be raised, so that it is possible to cope with the case where a high refresh rate is not always necessary as in the case where the temperature is high, characters or the like are displayed, or the like.

In the embodiment, by making the number of lines of the repeating period variable, the ratio between the refreshing cycle and the partial rewriting cycle can be finely changed, thereby obtaining the finer optimum display. For instance, when a priority must be given to the refresh rate or the operator wants to give a priority to the refresh rate, by setting the number of lines of the repeating period to 40 lines and by setting $T_a$:$T_b$=4:1, it is possible to perform the refreshing cycle of the whole surface for 32 lines and to execute the rewriting cycle of the address line for eight lines. On the other hand, when a priority can be given to the partial rewriting or the operator wants to give a priority to the partial rewriting, by setting the number of lines of the repeating period to ten lines and by setting $T_a$:$T_b$=3:2, it is possible to execute the refreshing cycle of the whole surface for six lines and to perform the rewriting cycle of the access line for four lines.

Further, in a range of the number of lines for partial rewriting which has been set as mentioned above, the number P of lines for the actual partial rewriting operation which is executed during the refreshing cycle can be also adjusted in accordance with the number of lines accessed by the CPU 11 and the line access state. That is, by dynamically adjusting the time $T_b$ in accordance with the number of lines accessed by the CPU 11 or the like, the vain line rewriting cycle is omitted when, for example, the lines are not so frequently accessed from the CPU 11, and the refresh rate is improved. Due to this, the relation between the tracking performance of the operation and the refresh rate can be dynamically optimized. The above techniques have been disclosed in Japanese Patent Appln. Laid-Open No. 4-003112 filed by the same applicant as the present invention.

(1.5) Construction of the FLCD 26

Figure 5:
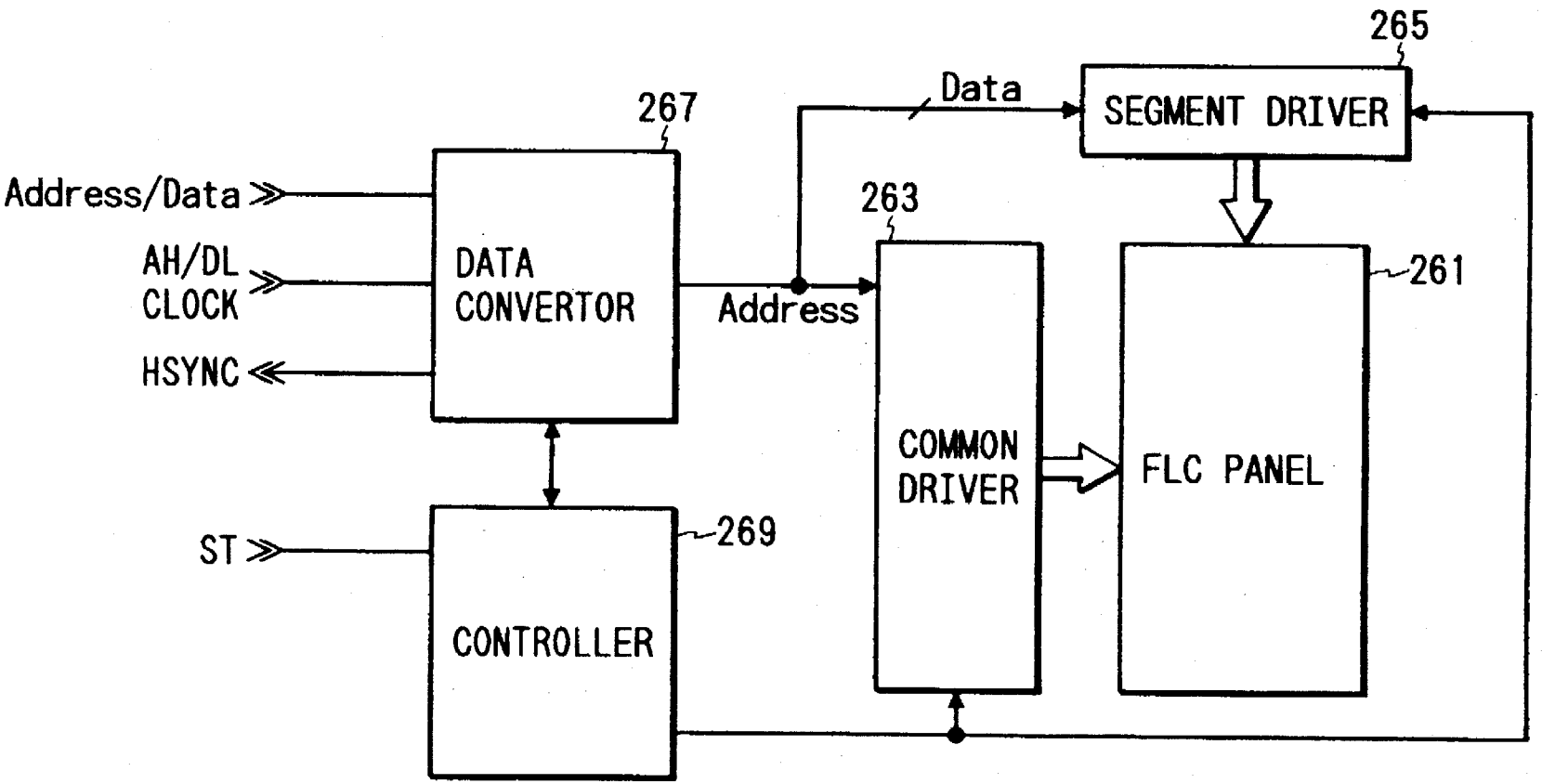
FIG. 5 is a block diagram showing an example of a construction of an FLCD in the embodiment of the invention.

FIG. 5 shows an example of a construction of the FLCD 26. Reference numeral 261 denotes an FLC panel. For instance, as disclosed in Japanese Patent Appln. Laid-Open No. 63-243919, the FLC panel 261 comprises: a pair of upper and lower glass substrates with deflectors in which an FLC is sealed between the glass substrates; groups of transparent electrode wirings provided on the upper and lower glass substrates; and the like. The wiring directions of the wiring group on the upper glass substrate and the wiring direction of the wiring group on the lower glass substrate are set to cross perpendicularly to each other. The numbers of wirings can be properly determined in accordance with the size of display screen and the resolution. In the embodiment, 960 wirings are provided in the horizontal scanning direction at a density of 4 pel and 1312 wirings are provided in the vertical scanning direction. Since an orienting state of the FLC in the intersecting portion of the wirings can be changed in accordance with the polarity and intensity of an electric field which is caused in the intersecting portion, the number of display elements of the FLC panel in the embodiment is equal to 1312×960.

In the embodiment, the group of 1312 wirings in the vertical scanning direction are called common side wirings and the foregoing sequential line addresses are assigned to them. The group of 960 wirings in the horizontal scanning direction are called segment side wirings. When a certain common side wiring (line) is selected and driven, by driving the segment side wiring group, the display, erasure, and updating of the relevant line are executed.

In FIG. 5, reference numerals 263 and 265 denote drivers (referred to as a common driver and a segment driver) to drive the common side wiring group and the segment side wiring group. Each of the drivers 263 and 265 drives the wirings by a voltage signal of a proper waveform in accordance with the display data. In this instance, the waveforms or the like have been disclosed in, for example, Japanese Patent Appln. Laid-Open No. 63-243919.

A display data signal relates to a display line and is supplied from the video memory 41 as a serial signal Address/Data comprising a portion indicative of the address of the line and the data (data of 960 dots) subsequent to the line address portion. In order to discriminate the address portion of the display data signal and the data portion, a discrimination signal AH/DL which is set to the high level in the address portion and to the low level in the data portion is supplied. In a data converter 267, the address (line address) Address and the data Data are separated from the display data signal Address/Data on the basis of the discrimination signal AH/DL and supplied to the common driver 263 and segment driver 265, respectively. The horizontal scan signal HSYNC is transmitted from the data converter 267 to the FLCD interface side.

Reference numeral 269 denotes a controller for receiving the time-up signal D which is generated from a timer 46 as a static mode instruction signal ST and for controlling the common driver 263 and segment driver 265 so as to stop the driving of the FLC panel when the signal ST is supplied. Various methods of stopping the driving are considered. For instance, the driving of the FLC panel can be stopped by keeping output voltages to both of the drivers to predetermined values. In this case, since there is no potential difference between the common line and the segment line, the FLC device is not driven, so that a long life as a main object of the invention can be accomplished. When an output voltage at that time is set to a low voltage, an electric power consumption can be reduced. As mentioned above, even when the driving is stopped, no change occurs in the orienting state due to the characteristics of the FLC device. Therefore, the display function is not obstructed. Rather, by setting the nondriving state, the display content is not updated (refreshed) as well, so that a display state without flickering is obtained.

(1.6) Static Mode

Figure 6:
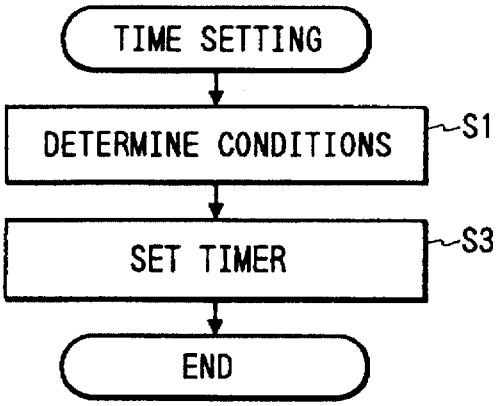
FIG. 6 is a flowchart showing an example of a procedure for setting a static-mode shift time.

In the embodiment, a period of time which is required until the operating mode is shifted to the static mode is made variable by changing the time which is set into the timer 46. The setting of the time into the timer 46 is executed by a procedure as shown in FIG. 6. Namely, in step S1, conditions to set the time are first discriminated. In step S3, the time is set into the timer by the CPU 11 through the bus driver 47 on the basis of the conditions discriminated.

Various methods for the discrimination of the conditions in step S1 are considered. For example, in the case where a volume, a switch, or the like to instruct the change of the time is provided for the system, the operating state can be discriminated in accordance with the operation of the volume or switch. Or, when a predetermined key operation can be accepted, the operating state can be discriminated in accordance with the operation of such a key. On the other hand, since the frequency of updating of the display content also differs in dependence on the application, the application which is used at present can be also discriminated. Further, a graphic event such as movement of a cursor or the like can be also discriminated. In addition, since the operating speed of a key or a mouse to update the display content also differs in dependence on a degree of skill of the operator, the display updating interval or the like can be also discriminated. Or, a combination of the above methods can be also used.

It is also possible to form a timer set value as a table in a predetermined memory in correspondence to the conditions as mentioned above, thereby allowing a proper value to be set into the timer 46 in step S3.

A procedure of FIG. 6 can be also properly made operative in response to the operation of the operator or periodically or in accordance with a change of the application.

Figure 7:
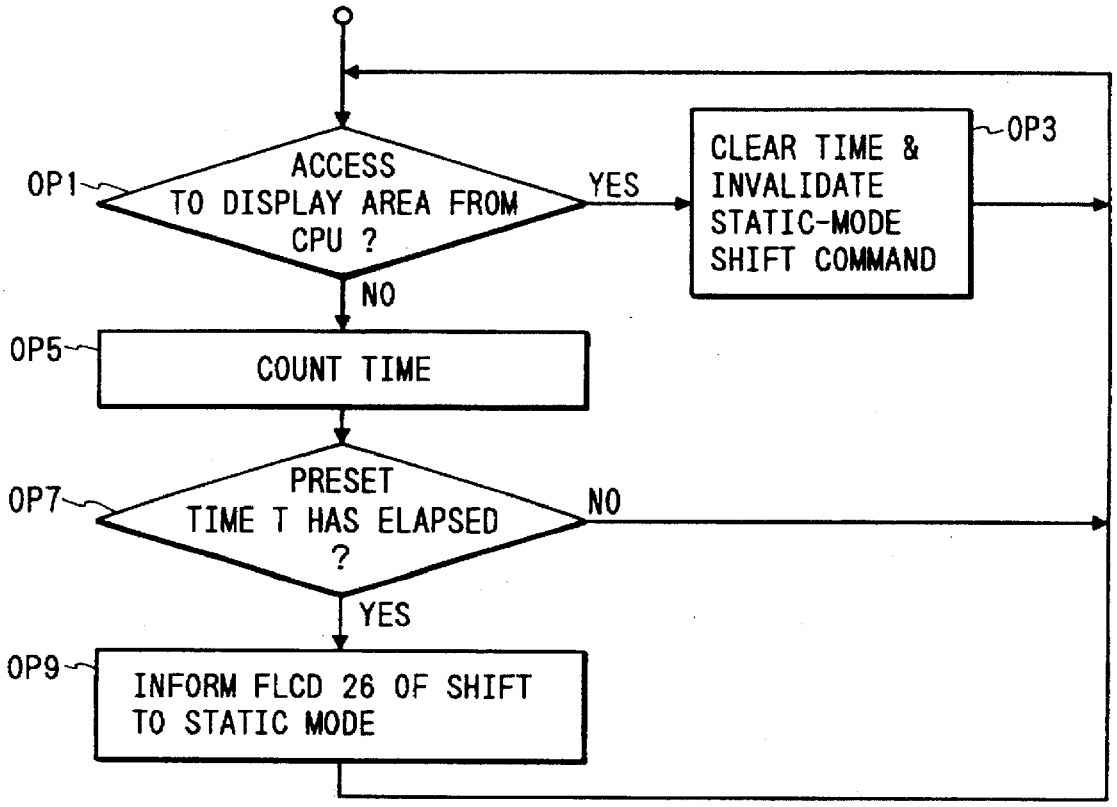
FIG. 7 is a flowchart for explaining the operation of the embodiment of the invention.
Figure 8:
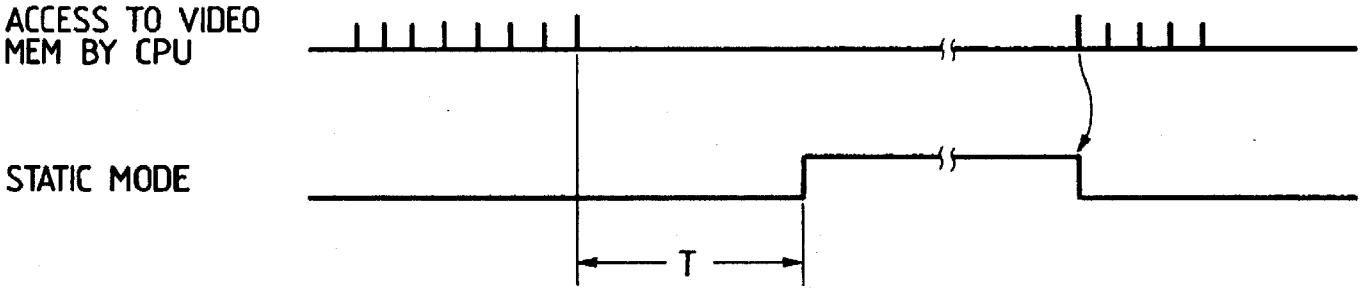
FIG. 8 is a timing chart for explaining the operation of the embodiment of the invention.

FIGS. 7 and 8 are a flowchart and a timing chart for explaining the operation in the static mode. That is, when a display area is accessed from the CPU 11 (OP1), the stop of the counting operation from the time point of the previous accessing operation, the start of the counting operation from the present time point, and the invalidation of the static command signal are executed (OP3).

On the contrary, when the display area is not accessed, the counting operation is continued (OP5). When the time T set in step S3 elapses (OP7), the operating mode is shifted to the static mode and the mode shift is informed to the FLCD 26 (OP9).

The above operations are practically executed as operations of the memory controller 40 and timer 46 in FIG. 3. That is, the memory controller 40 informs the access of the video memory 41 by the CPU 11 to the timer 46. In response to such a notification, the timer 46 resets the counted time and restarts the counting operation. When the set time times up, the timer 46 notifies the time-up to the FLCD 26 by a time-up signal D. When the video memory 41 is accessed by the CPU 11 even in the static mode, it will be obviously understood that the timer is reset/restarted and the time-up signal D is invalidated and the static mode of the FLCD 26 is cancelled.

(2) Second embodiment

In the first embodiment, the signal ST to instruct the shift to the static mode is sent to the FLCD, thereby setting the static mode. In the embodiment, the FLCD interface transmits the horizontal sync signal HSYNC to the FLCD and the operating mode is shifted to the static mode by using the HSYNC signal. That is, the FLCD in the embodiment is allowed to function as a passive device which receives the HSYNC signal and operates for the host computer or the FLCD interface in a manner similar to the well-known LCD or CRT, thereby obtaining a non-driving state of the FLC panel by using a part of the function.

Figure 9:
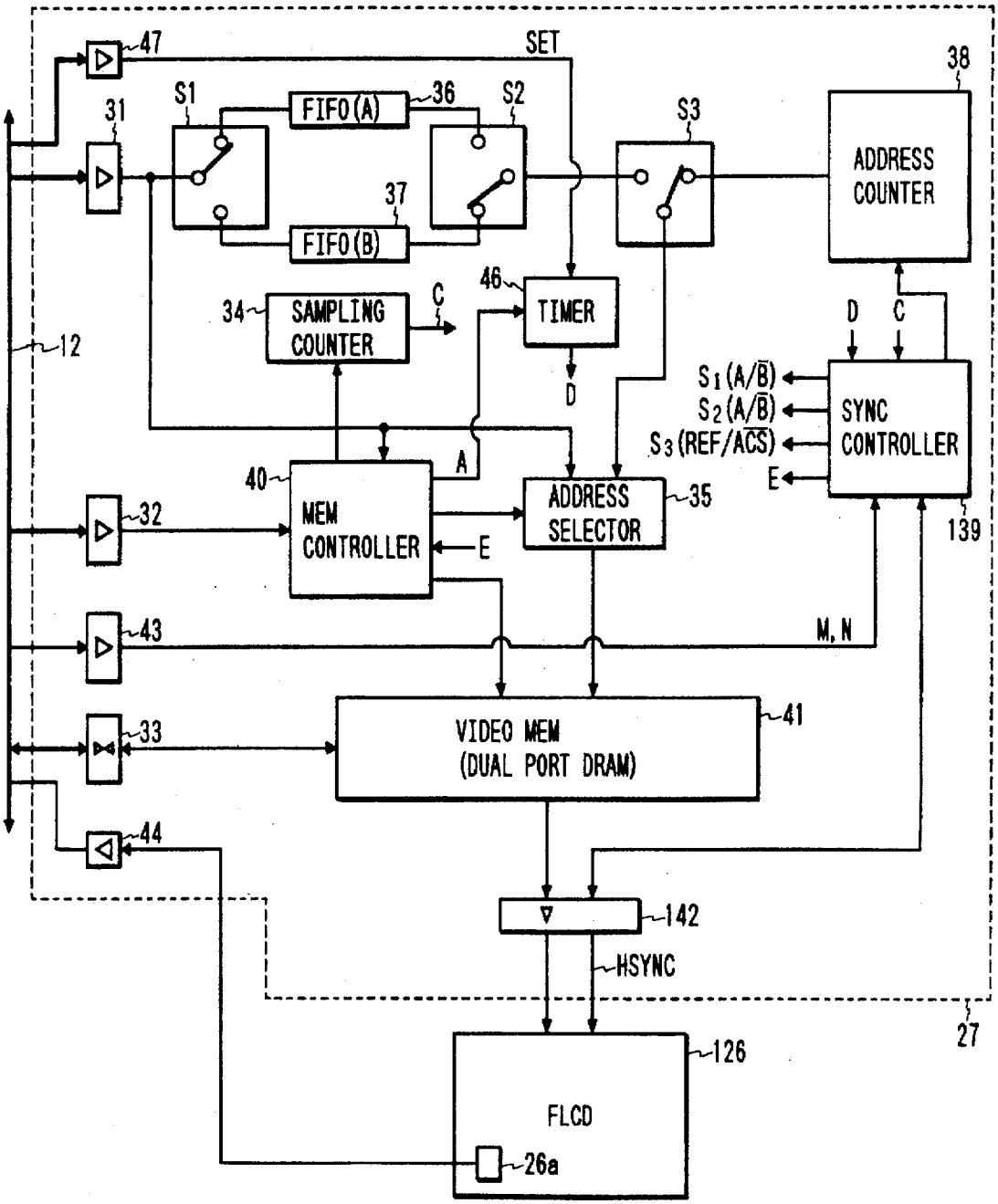
FIG. 9 is a block diagram showing a construction of an FLCD interface as another embodiment of the invention.

FIG. 9 shows a construction of the FLCD interface in the embodiment and component elements similar to those shown in FIG. 3 are designated by the same reference numerals.

A sync controller 139 in the second embodiment is substantially similar to the sync controller 39 in FIG. 3 except that the sync controller 139 has an oscillator, a frequency divider, and the like to generate the HSYNC signal and that the HSYNC signal is supplied to an FLCD 126 through a driver 142. The supply of the HSYNC signal is stopped in response to the time-up signal D which is generated from the timer 46. To stop the supply of the HSYNC signal, it is sufficient to add a logic gate such as to invalidate the HSYNC signal in accordance with the time-up signal D.

Figure 10:
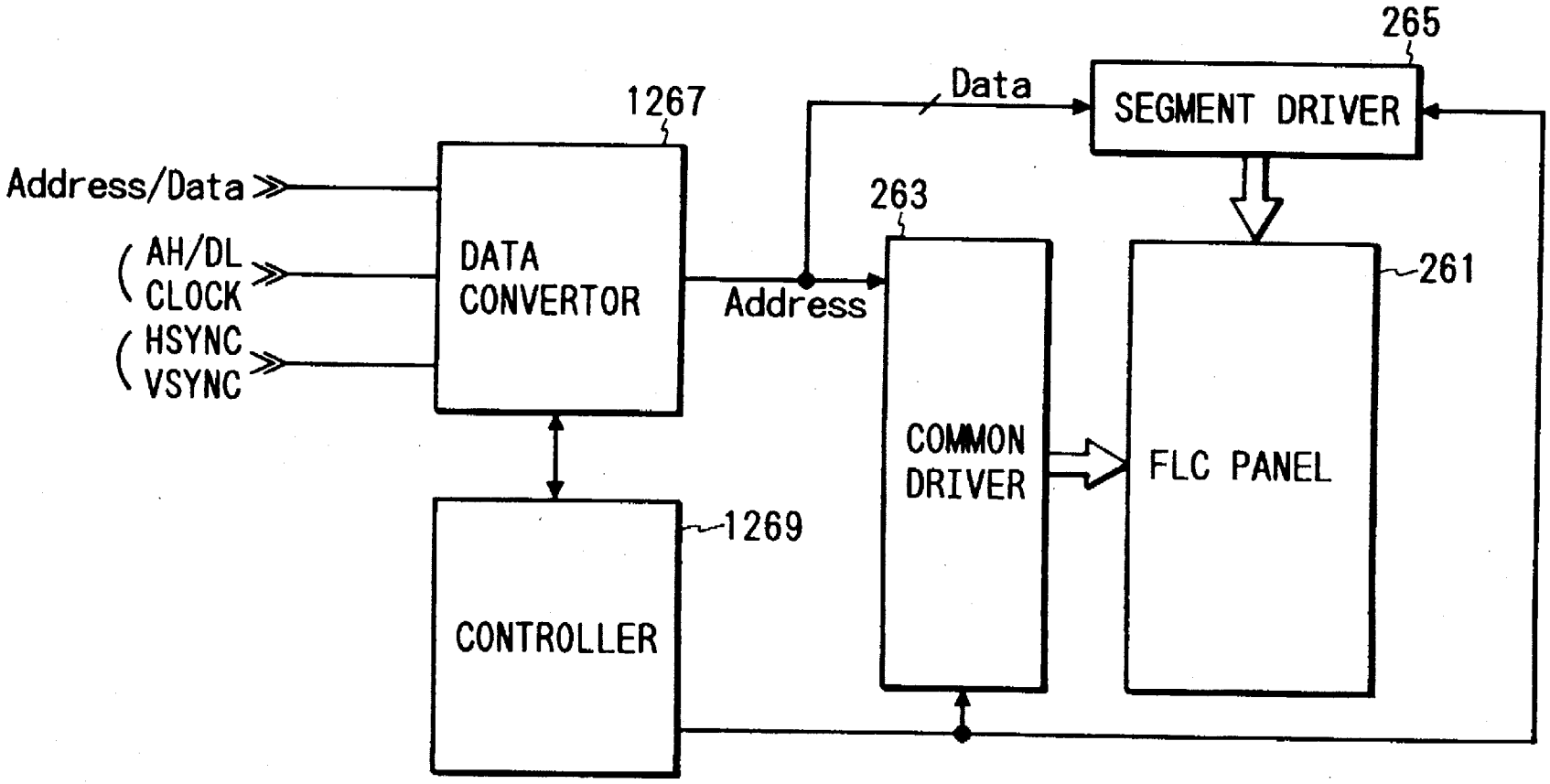
FIG. 10 is a block diagram showing an example of a construction of an FLCD in another embodiment of the invention.

FIG. 10 shows an example of a construction of the FLCD 126 in the second embodiment. The FLC panel 261, common driver 263, and segment driver 265 have the same construction as that shown in FIG. 5 of the first embodiment. A data converter 1267 and a controller 1269 are also similar to the data converter 267 and controller 269 in FIG. 5. However, the data converter 1267 of the embodiment executes the operation to separate the Address signal portion and the Data signal portion from the display data signal in response to the HSYNC signal which is supplied from the FLCD interface side. When the supply of the HSYNC signal is stopped, the controller 1269 controls the common driver 263 and segment driver 265 so as to stop the driving of the FLC panel 261. Thus, the operating mode is shifted to the static mode.

In the embodiment as well, a period of time which is required until the operating mode is shifted to the static mode can be varied by changing the time which is set into the timer 46. The setting of the time into the timer 46 can be executed in a manner similar to that mentioned in FIG. 6.

Figure 12:
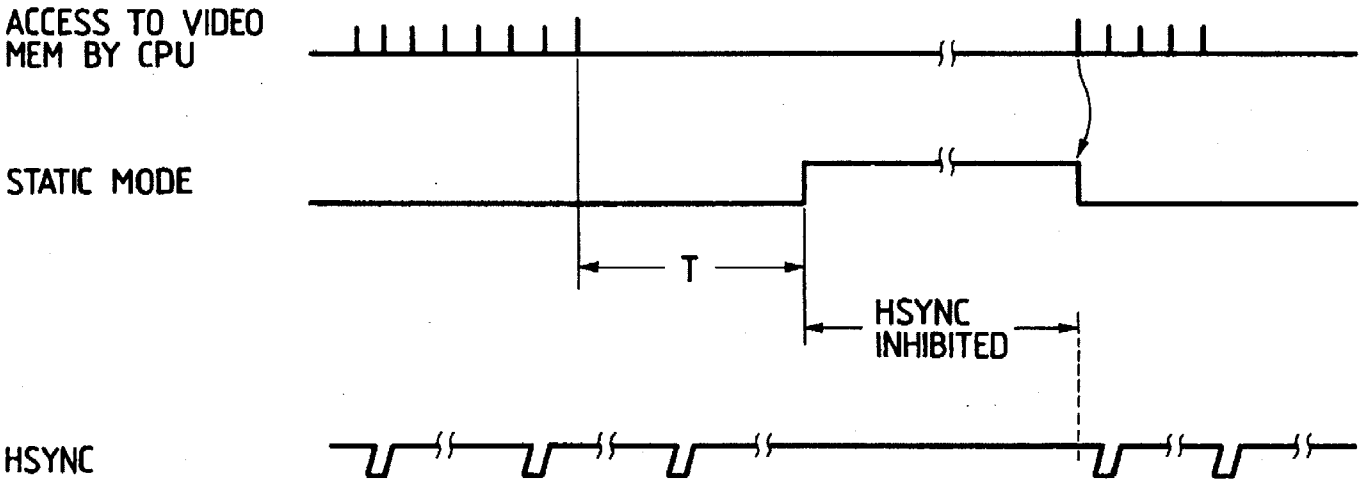
FIG. 12 is a timing chart for explaining the operation of another embodiment of the invention.
Figure 11:
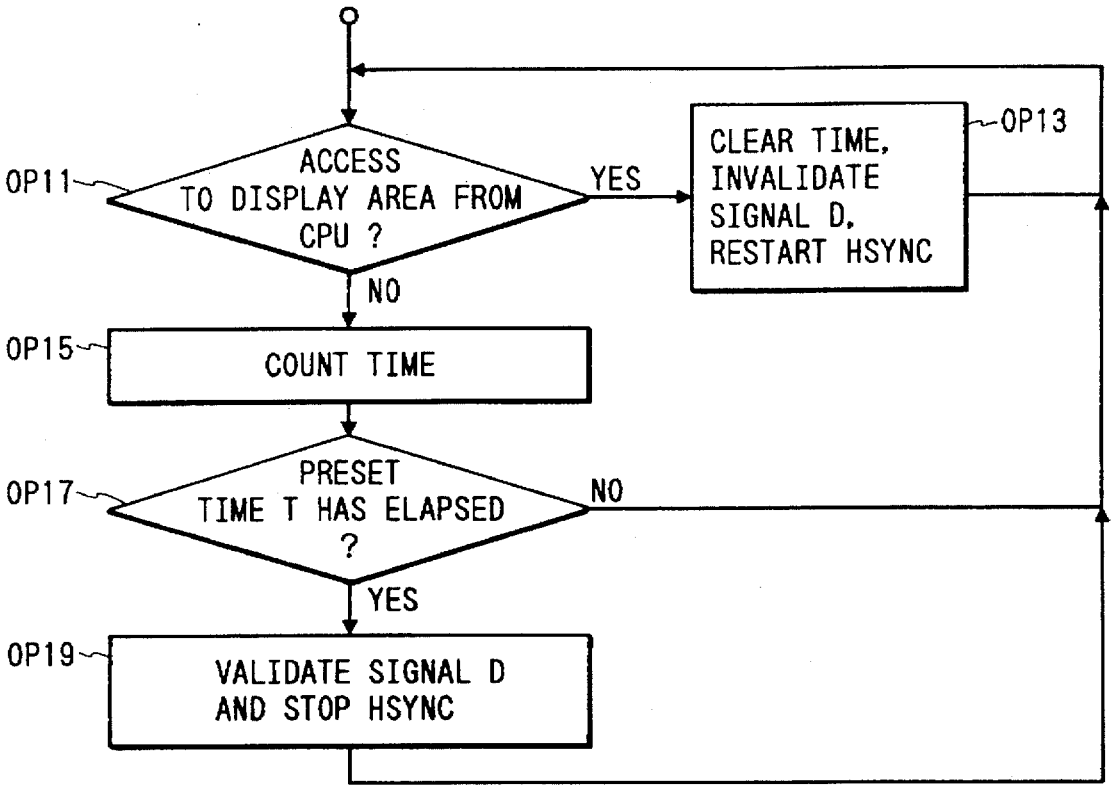
FIG. 11 is a flowchart for explaining the operation of another embodiment of the invention.

FIGS. 11 and 12 are a flowchart and a timing chart for explaining the operation in the static mode in the second embodiment. That is, when a display area is accessed from the CPU 11 (OP11), the stop of the counting operation from the time point of the previous accessing operation, the start of the counting operation from the present time point, the invalidation of the time-up signal D to shift to the static mode, and the restart of the generation of the HSYNC signal are executed (OP13).

On the contrary, when the display area is not accessed, the counting operation is continued (OP15). In a manner similar to step S3 in FIG. 6, when the set time elapses (OP17), the time-up signal D to shift to the static mode is validated and the generation of the HSYNC signal is stopped (OP19).

Practically speaking, the above operations are executed as operations of the memory controller 40 and timer 46 and sync controller 139 in FIG. 9. That is, the memory controller 40 informs the access of the video memory 41 by the CPU 11 to the timer 46. In response to such a notification, the timer 46 resets the time counted and restarts the counting operation. When the set time times up, such a time-up is informed to the sync controller 139 as a time-up signal D. In response to the time-up signal D, the sync controller 139 stops the supply of the HSYNC signal to the FLCD 126, so that the driving of the PLC panel 26 is stopped. When the video memory 41 is accessed by the CPU 11 even in the static mode, it will be obviously understood that the timer is reset/restarted and the time-up signal D is invalidated and the supply of the HSYNC signal is restarted and the static mode of the FLCD 26 is cancelled.

In the embodiment, an effect similar to that of the first embodiment mentioned above is also obtained. In the second embodiment, further, since a special signal which is supplied to the FLCD side in order to obtain the static mode is unnecessary, the construction of the connecting portion can be simplified. Since the HSYNC signal is generated from the FLCD interface side, a circuit to monitor the HSYNC signal on the side of the FLCD interface or host computer and the circuit to generate the HSYNC signal on the FLCD side are unnecessary. The interface between the well-known LCD and CRT can be also further commonly constructed. Moreover, when the Address/Data signal in FIG. 10 is set to only the Data signal and the accessing method of the FLC panel is set to, for example, only the fixed interlace scan, the interface with the well-known LCD can be also commonly constructed.

According to the invention as described above, the preserving performance of the display in the display panel of the FLCD or the like is effectively used. When the display content is not updated, the driving of the display panel is stopped. Thus, a long life of the display panel can be realized.

What is claimed is:

1. A display control apparatus comprising:

display means for displaying data based on display data stored in memory means, said display means having a first group of electrodes and a second group of electrodes arranged therein;

driving means for driving said first and second groups of electrodes;

monitor means for monitoring whether the display data has been supplied to the memory means; and control means for supplying a control signal to said driving means for controlling said driving means such that no potential difference is established between said first group of electrodes and said second group of electrodes if said monitor means detects that the display data has not been supplied to the memory means for a predetermined time or more for causing said display means to maintain displaying of data displayed before no potential difference is established between said first group of electrodes and said second group of electrodes.

2. An apparatus according to claim 1, wherein said monitor means monitors the display data which is supplied to said memory means.

3. An apparatus according to claim 2, further having a timer to count the predetermined time, and wherein said timer is reset/started in dependence on a supplying state of the display data to said memory means.

4. An apparatus according to claim 1, wherein said display means is a ferroelectric liquid crystal device.

5. An apparatus according to claim 1, wherein if said monitor means detects that the display data is supplied to said memory means when no potential difference is established between said first group of electrodes and said second groups of electrodes, said control means controls said driving means based on the supplied display data.

6. A display system comprising:

storage means for storing display data;

display means comprising first and second electrodes, for displaying data based on the display data stored in said storage means;

supplying means for supplying the stored display data to said display means;

monitor means for monitoring whether the display data has been supplied to said storage means; and driving means for supplying a drive signal to said display means for driving said display means such that no potential difference is established between said first and second electrodes if said monitor means detects that the display data has not been supplied to the memory means for a predetermined time for causing said display means to maintain displaying of data displayed before no potential difference is established between said first group of electrodes and said second group of electrodes.

7. A system according to claim 6, further having a timer to count the predetermined time, and wherein said timer is reset/started in dependence on a supplying state of the display data to said storage means.

8. A system according to claim 6, wherein said display means comprises a display screen using a ferroelectric liquid crystal device as a display device.

9. A system according to claim 6, wherein the driving of said display means is stopped by stopping a sync signal which is supplied from said driving means.

10. A system according to claim 6, further having setting means for setting said predetermined time to a set time, and wherein the driving of said display means is stopped on the basis of the set time.

11. A system according to claim 6, wherein if said monitor means detects that the display data is supplied to said storage means when no potential difference is established between said first and second electrodes, said driving means drives said display means based on the supplied display data.

12. A display control method of displaying data by driving display means having first and second electrodes on the basis of display data supplied from a memory, said method comprising the steps of:

monitoring whether the display data has been supplied to the memory;

counting a time duration in which the display data is not supplied to the memory; and driving the display means, by application of a drive signal, such that no potential difference is established between the first and second electrodes when the counted time duration has reached a predetermined value for causing the display means to maintain displaying of data displayed before no potential difference is established between the first and second electrodes.

13. A method according to claim 12, wherein the counted time is reset when the display data is supplied.

14. A method according to claim 12, wherein if it is detected in said monitoring step that the display data is supplied to the memory when no potential difference is established between the first and second electrodes, said driving step drives the display means based on the supplied display data.

* * * * *

UNITED STATES PATENT AND TRADEMARK OFFICE

CERTIFICATE OF CORRECTION

PATENT NO. : 5,686,934

DATED : November 11, 1997

INVENTOR(S) : HIROSHI NONOSHITA ET AL.

It is certified that error appears in the above-identified patent and that said Letters Patent is hereby corrected as shown below:

On the title page item,

[56] REFERENCES CITED

U.S. Patent Documents:
Insert: --4,964,699 10/1990 Inoue--.
Foreign Patent Documents
Insert: --4-3112 1/1992 Japan--.
Insert: --63-243919 10/1988 Japan--.

[57] ABSTRACT

Line 4, "access" should read --an access--.
Line 5, "display" should read --a display--.
Line 9, "display" (both occurrences) should read --a display--.

COLUMN 1

Line 52, "632243919" should read --63-243919--.

Signed and Sealed this

Eighteenth Day of August, 1998

Bruce Lehman

*Attest:*

BRUCE LEHMAN

*Attesting Officer*

*Commissioner of Patents and Trademarks*